United States Patent [19]

Morrow, Sr. et al.

[11] 4,050,586

[45] Sept. 27, 1977

[54] APPARATUS FOR RAISING & LOWERING A MAST AND BOOM ON A MOBILE CRANE

[75] Inventors: James G. Morrow, Sr.; David J. Pech; Charles A. Hunter, II; Kenneth J. Porubcansky, all of Manitowoc, Wis.

[73] Assignee: The Manitowoc Company, Inc., Manitowoc, Wis.

[21] Appl. No.: 625,197

[22] Filed: Oct. 23, 1975

[51] Int. Cl.[2] ..... B66C 23/54

[52] U.S. Cl. ..... 212/59 R; 212/46 R

[58] Field of Search ..... 212/58 R, 59 R, 48 R, 212/144, 8 R, 9, 46 R, 46 A, 46 B, 48

[56] References Cited

U.S. PATENT DOCUMENTS

| | | | |
|---|---|---|---|
| 3,037,641 | 6/1962 | Potter et al. | 212/46 A |
| 3,374,901 | 3/1968 | Ferwerda | 212/59 R |
| 3,485,383 | 12/1969 | Beduhn | 212/48 |
| 3,874,532 | 4/1975 | Metailler | 212/59 R |
| 3,884,359 | 5/1975 | Suverkrop | 212/59 R |
| 3,944,081 | 3/1976 | Wellman | 212/46 B |

FOREIGN PATENT DOCUMENTS

| | | | |
|---|---|---|---|
| 1,279,491 | 11/1961 | France | 214/145 A |
| 2,334,435 | 7/1973 | Germany | 212/46 R |
| 1,252,862 | 10/1967 | Germany | 212/46 R |

*Primary Examiner*—Albert J. Makay
*Assistant Examiner*—R. B. Johnson
*Attorney, Agent, or Firm*—Leydig, Voit, Osann, Mayer & Holt, Ltd.

[57] ABSTRACT

A self-erecting mast and boom for a lift crane including self-storing mast cylinders for erecting the mast and rotating a pivoted boom carrier into position to receive the boom which may then be raised by the boom hoist mechanism of the crane. A back hitch assembly including hydraulic cylinders is employed to initially raise the mast and the gantry members which may be lowered into horizontal position to reduce the crane profile for self-propelled transport between job sites.

7 Claims, 5 Drawing Figures

10
12
13
14
15
16
17
18
19
20
21
22
23
24
25
26
27
28
29
30
31
32
33
35
36
37
40
41
42
43
44
45
46
47
48
49
70
71

APPARATUS FOR RAISING & LOWERING A MAST AND BOOM ON A MOBILE CRANE

The present invention relates generally to load handling devices and more particularly concerns a self-erecting mast and boom for lift cranes.

One of the difficulties with very large load handling devices, such as mobile lift cranes, is that due to their size they must be at least partially disassembled for shipment and transport from one job site to another. This is particularly true with respect to the boom structure of such large lift cranes which is typically disassembled from the upper works of the crane when it is to be moved from one job site and then the boom must be reassembled and erected to its operating position at the new job site.

Accordingly, it is the primary aim of the present invention to provide a mobile lift crane with a self-erecting mast and boom assembly which facilitates the assembly and disassembly of the boom with respect to the crane upper works. A more detailed object is to provide a self-erecting mast and back hitch assembly which may be folded back over the rear of the crane upper works to decrease the crane's profile for self-propelled movement from one location to another.

It is a more specific object to provide a folding back hitch assembly for a lift crane with a hydraulic cylinder arrangement effective to initially raise the pivotally mounted mast of such a crane and to provide the mast with self-storing hydraulic cylinders effective to subsequently raise the mast not only to its operating position but also to a forwardly inclined position where it may be employed to facilitate assembly and disassembly of the boom structure.

Yet another object of the invention is to provide a pivotally mounted boom carrier on which a self-erecting mast is also pivotally mounted and the carrier may be rotated upwardly and forwardly by the mast cylinders to a position for assembly and disassembly to a substantially horizontally aligned boom.

These and other objects and advantages of the invention will become apparent upon reading the following detailed description and upon reference to the drawings in which:

FIG. 1 is a side elevation of a lift crane embodying the self-erecting mast and boom of the present invention in operating position;

FIG. 2 is an enlarged, fragmentary side elevation of the rotatable bed of the lift crane shown in FIG. 1 illustrating: in substantially horizontal dash lines, the back hitch, gantry and mast in folded transport position; in solid lines, the mast raised to its initial erection position by the back hitch and gantry mechanism; and, in substantially vertical broken lines, the mast raised to a subsequent position by its self-erecting cylinders;

FIG. 4 is an enlarged fragmentary section taken substantially along the line 4—4 in FIG. 3; and, FIG. 5 is a fragmentary side elevation, similar to FIG. 3, illustrating: in solid lines, the mast in the forwardly leaning position of FIG. 3; and, in broken lines, the boom carrier rotated forwardly with the mast raised upwardly and in a more forwardly inclined position.

While the invention will be described in connection with a preferred embodiment, it will be understood that we do not intend to limit the invention to that embodiment. On the contrary, we intend to cover all alternatives, modification and equivalents as may be included within the spirit and scope of the invention as defined by the appended claims.

Figure 1:
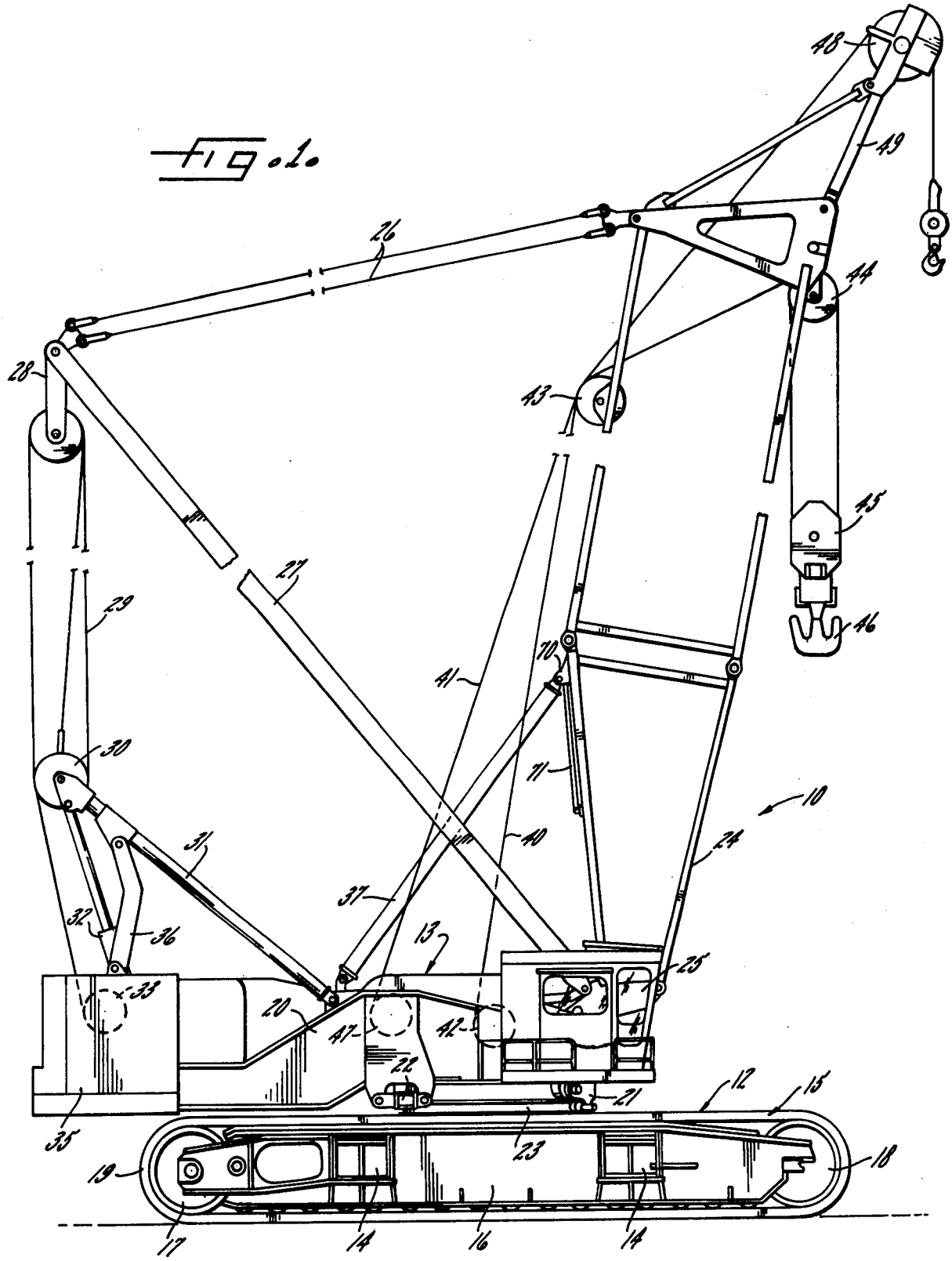

Turning now to the drawings, there is shown in FIG. 1 a load handling device in the form of a lift crane assembly 10, with which the present invention is associated. The crane assembly 10 includes lower works 12 and upper works 13. The lower works 12 includes a pair of transverse beams 14 the ends of which are supported by a pair of traction assemblies 15 (only one of which is shown). Each traction assembly 15 includes side frames 16 which support a drive sprocket 17 and an idler sprocket 18 around which a crawler tread 19 runs.

The upper works 13 of the crane assembly 10 includes a rotatable bed 20 supported by front and rear roller assemblies 21, 22 which engage a ring gear and roller path 23 on the lower works 12. A working boom 24 is pivotally connected to the forward end of the rotatable bed 20 by a boom carrier 25 in the form of a pair of laterally spaced butt plates (only one of which is shown). The boom 24 is supported by two pairs of laterally spaced pendants 26 (only one pair of which is shown) extending rearwardly to the upper ends of laterally spaced masts 27, each of which carries an equalizer assembly 28 around which a boom hoist line 29 runs. Another equalizer assembly 30 is carried by the upper end of a pair of pivotally mounted gantry members 31 which are raised and held in position by a back hitch assembly in the form of a pair of hydraulic cylinders 32 (only one of which is shown). Preferably, each of the boom hoist lines 29 form a multi-part line between the equalizer assemblies 28, 30 and the other end of each line is wound on a drum 33 of a dual drum boom hoist at the rear of the upper works 13. In order to accommodate heavy loads, the crane 10 carries, at the rear of the rotatable bed 20, a large counterweight 35 which is coupled to the gantry member 31 by links 36.

As will be appreciated by those skilled in the art, the foregoing components of the crane 10, although illustrated somewhat schematically, are shown in FIG. 1 in substantially their normal operating positions. To prevent overcentering of the boom 25, the upper works 13 also carries automatic, cushioned boom stops 37. The illustrated crane 10 is also equipped with two lift lines 40 and 41. The front lift line 40 is wound on a drum 42 and extends over a sheave 43 on the rear side of the boom 24 and then makes a double reach between upper and lower equalizer assemblies 44, 45, respectively, carried by the boom and a main hook assembly 46. The rear lift line 41 is wound on another drum 47 and extends over another sheave 43 and then over an upper pulley assembly 48 mounted on the end of a boom extension 49. It will also be understood that the upper works 13 carries a suitable power source, such as a diesel engine (not shown) and appropriate variable control power transmission means for the major functions of the crane incuding hydraulic pump means and controls (not shown) for the back hitch cylinders 32.

Figure 2:
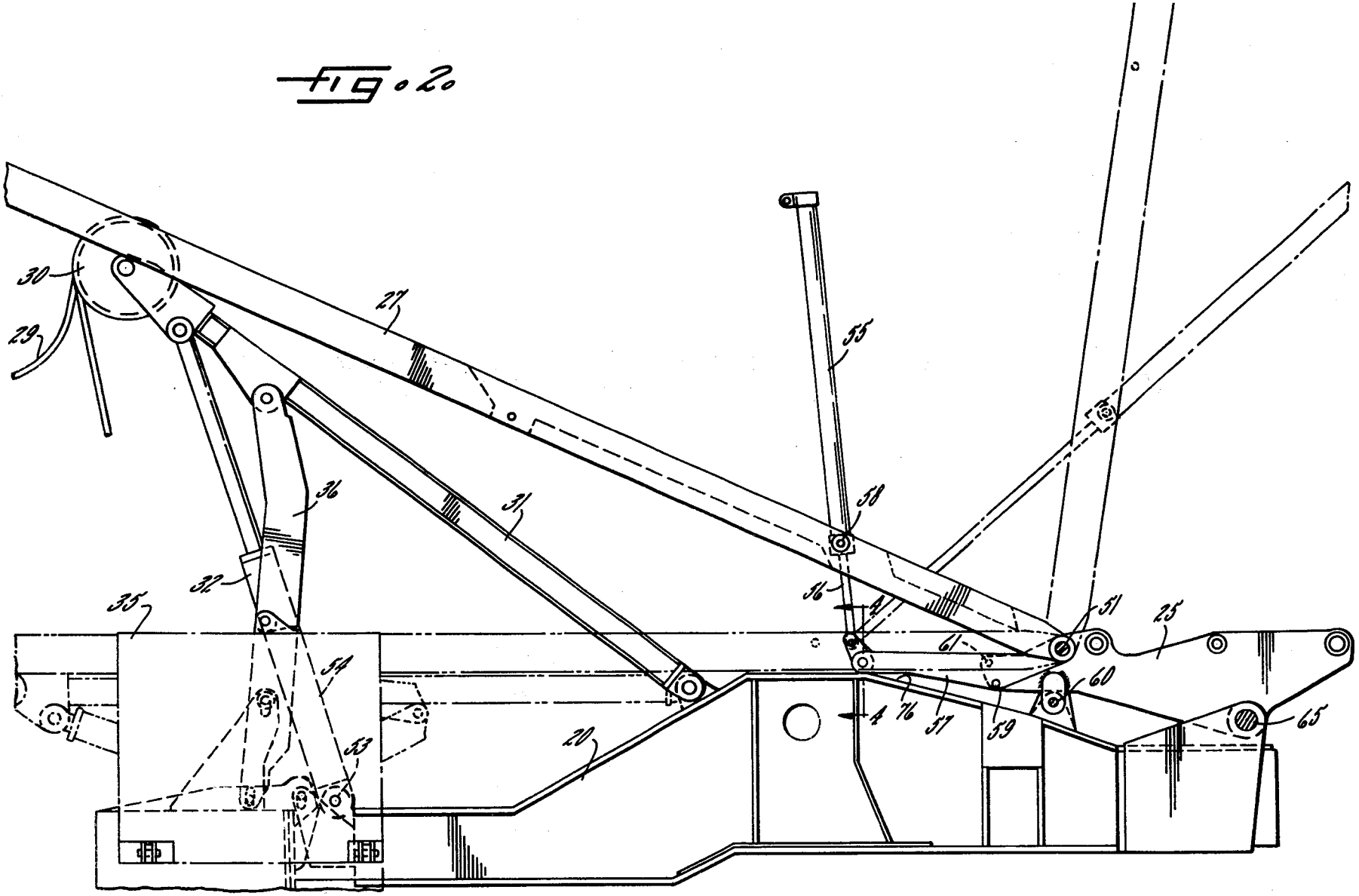

In accordance with the present invention, the boom 24 may be detached from carrier 25 and the masts 27, gantry members 31, back hitch cylinders 32 and counterweight links 36 may be folded down to substantially decrease the profile of the crane 10, as shown in the lower dash lines of FIG. 2, when it is moved from one job site to another. To this end, the masts 27 are pivotally mounted at the rear of the boom carrier 25 by pins 51 and the gantry members 31 and back hitch cylinders are pivotally mounted by pins 52 and 53 to lugs on the rotatable bed 20. The lift links 36 are connected to the counterweight 35 through a toggle link 54 and as the back hitch cylinders 32 are lowered, the links 36 and 54 fold or toggle together as shown in the lower dash line illustration of FIG. 2.

To raise the masts 27 and gantry members 31 from their lowered transport position, the back hitch cylinders 32 are actuated. This unfolds the links 36 and 54 and raises the gantry members 31 and masts 27 to the position shown by solid lines in FIG. 2. This is the operating position (see FIG. 1) for the gantry members 31, back hitch cylinders 32 and counterweight links 36 and 54 but is only an intermediate position for the masts 27. For raising the masts from their intermediate position to a substantially vertical but somewhat forwardly inclined position, illustrated at the right in FIG. 2, a pair of self-storing mast cylinders 55 (only one of which is shown) are provided. The piston rod 56 of each cylinder 55 is pinned to the end of a lever arm 57 which extends rearwardly from the mast pivot pin 51 and the cylinders 55 are pivotally connected by the pins 58 to their respective masts 27.

When the masts 27 are raised to their intermediate position (solid line in FIG. 2) by the back hitch cylinders 32, the piston rods 56 of the mast cylinders 55 are extended and the mast cylinders swing into a substantially vertical position. By actuating the mast cylinders 55, the rods 56 are fully extended and the masts 27 are rotated to their slightly forwardly inclined position in FIG. 2. It will be understood, of course, that the upper ends of the masts 27 carry the equalizer assemblies 28 which are interconnected by the multi-part lines 29 to the gantry equalizer assemblies 30 and to the drums 33 of the boom hoist winch.

Figure 3:
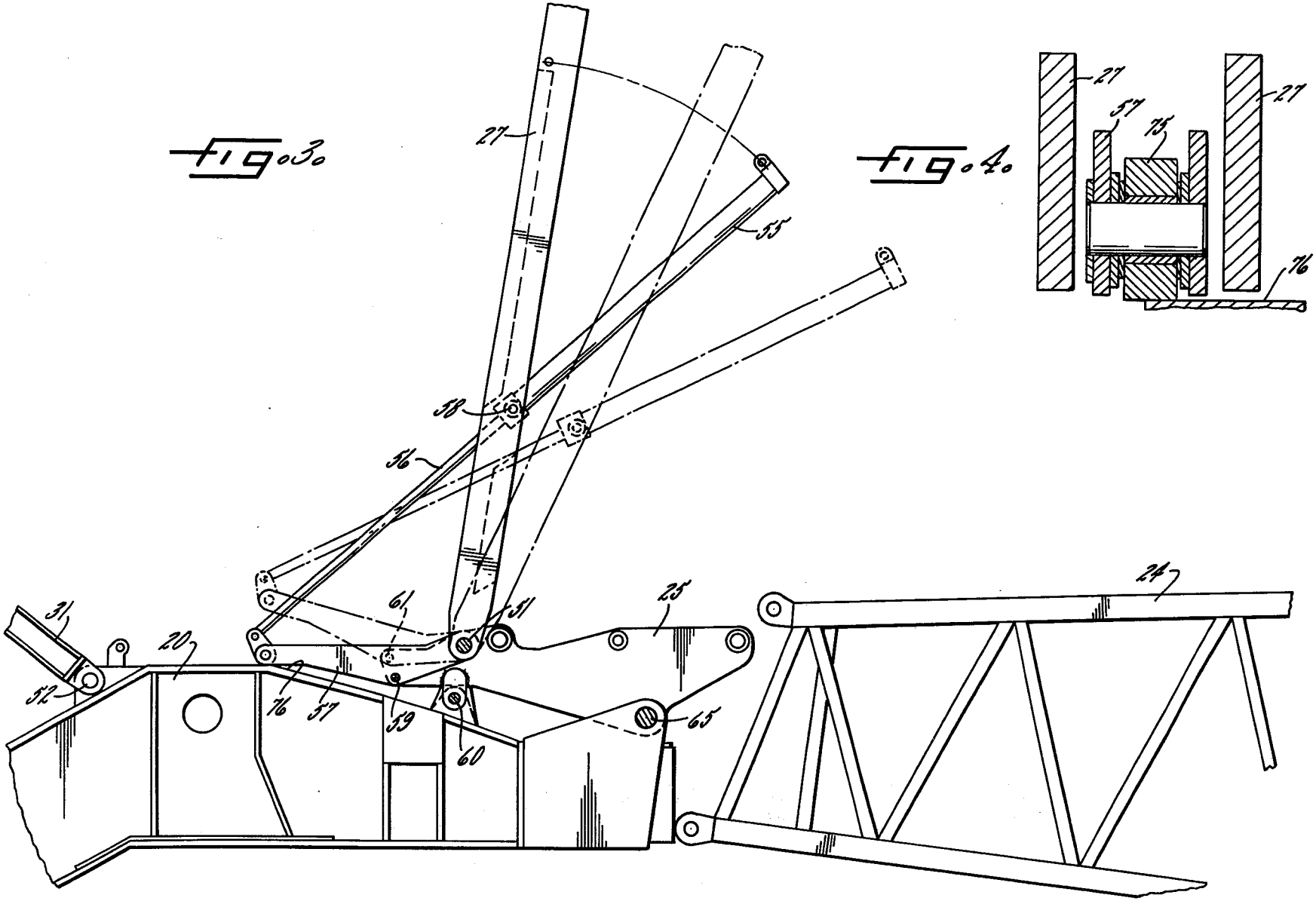
FIG. 3 is another fragmentary side elevation of a portion of the rotating bed, illustrating: in solid lines the mast shown in substantially vertical position; and, in dash lines, the mast in a forwardly inclining position.

Turning now to FIG. 3, the masts 27 are shown by solid lines here in their slightly forwardly inclined position. Further forward movement of the masts 27 is prevented by the fully extended mast cylinders 55 since the lever arms 57 are secured by pins 59 to the boom carrier 25 which, in turn, is pinned at 60 to a mounting ear on the rotating bed 20.

By removing the pins 59 and paying out cables 29 from the drums 33, the masts 27 are pivoted forwardly by their own weight about the pivots 51. At the same time the lever arms 57 are also rotated about the pivots 51 by the fully extended mast cylinders 55 to the dash line position of FIG. 3 where the pins 59 may be reinserted in a pair of upper holes 61 located in the boom carrier butt plates 25. As also shown in FIG. 3, the boom 24 is located in a substantially horizontal position ready for attachment to the crane 10.

In order to attach the boom 24 to the carrier 25, the latter must be rotated upwardly and forwardly about its main pivot pins 65. This is accomplished by first removing pins 60 from the carrier 25 and paying out more cable 29 from the drums 31. The overhanging weight of the masts 27 now swings the masts 27 and the carrier 25 about the pivot 65 until the rear end of the carrier is raised about 30° from the horizontal. At this point, the mast cylinders 55 are then retracted, pulling the lever arms 57 upwardly substantially into alignment with the masts 27 as shown in dash lines in FIG. 5. As this takes place, the boom carrier 25 is rotated upwardly and forwardly about the pivot 65 and, the masts 27 are carried upwardly as the lever arms 57 are drawn up into alignment with the masts 27.

The forward end of the masts 27 may now be rigged with a hoist line, such as 40 or 41, which can be used to help position the boom 24 relative to the boom carrier 25 for insertion of support pins 66 and 67. In addition, the mast cylinders 55 can be actuated to extend or retract the piston rods 56 slightly and thus rotate the boom carrier 25 aligning the holes in the boom 24 and carrier 25 to facilitate insertion of the pins 66 and 67. The pins 59 are then removed from the upper holes 61 in the carrier 25 and the mast cylinders 55 are retracted to swing them about their pivots 58 substantially into their self-storing position within the masts 27 (see dash lines FIG. 5). To achieve complete storing of the cylinders 55, the masts 27 may be lowered slightly, by paying out cables 29, while the upper end of the cylinders 55 are pushed into the masts 27 and locked in place by inserting pins 68.

Prior to erecting the boom 24, the automatic boom stops 37 are connected to the boom 24 and the rotating bed 20, the pendants 26 are connected between the boom 24 and the masts 27 and the lift lines 40 and 41 are rigged on the boom. In the preferred embodiment, the upper end of the boom stops 37 carry a support bracket 70 connected to the boom 24 by a pivotally mounted leg 71. As the boom 24 is raised, by taking up cables 29 on drums 33, the leg 71 rotates (clockwise as shown in FIG. 5) toward the boom into the folded position shown in FIG. 1 where the bracket 70 engages a cross bar (not shown) on the back side of the boom 24.

From the foregoing, it will be seen that the self-erecting masts 27 together with their self-storing cylinders 55 are effective for rotating the boom carrier 25 into position for assembly with the boom 24 which may then be raised to its erect position. When it is desired to disassemble the boom 24, for example in order to move the crane 10 to another job, substantially the reverse of the foregoing procedure is involved.

Figure 5:
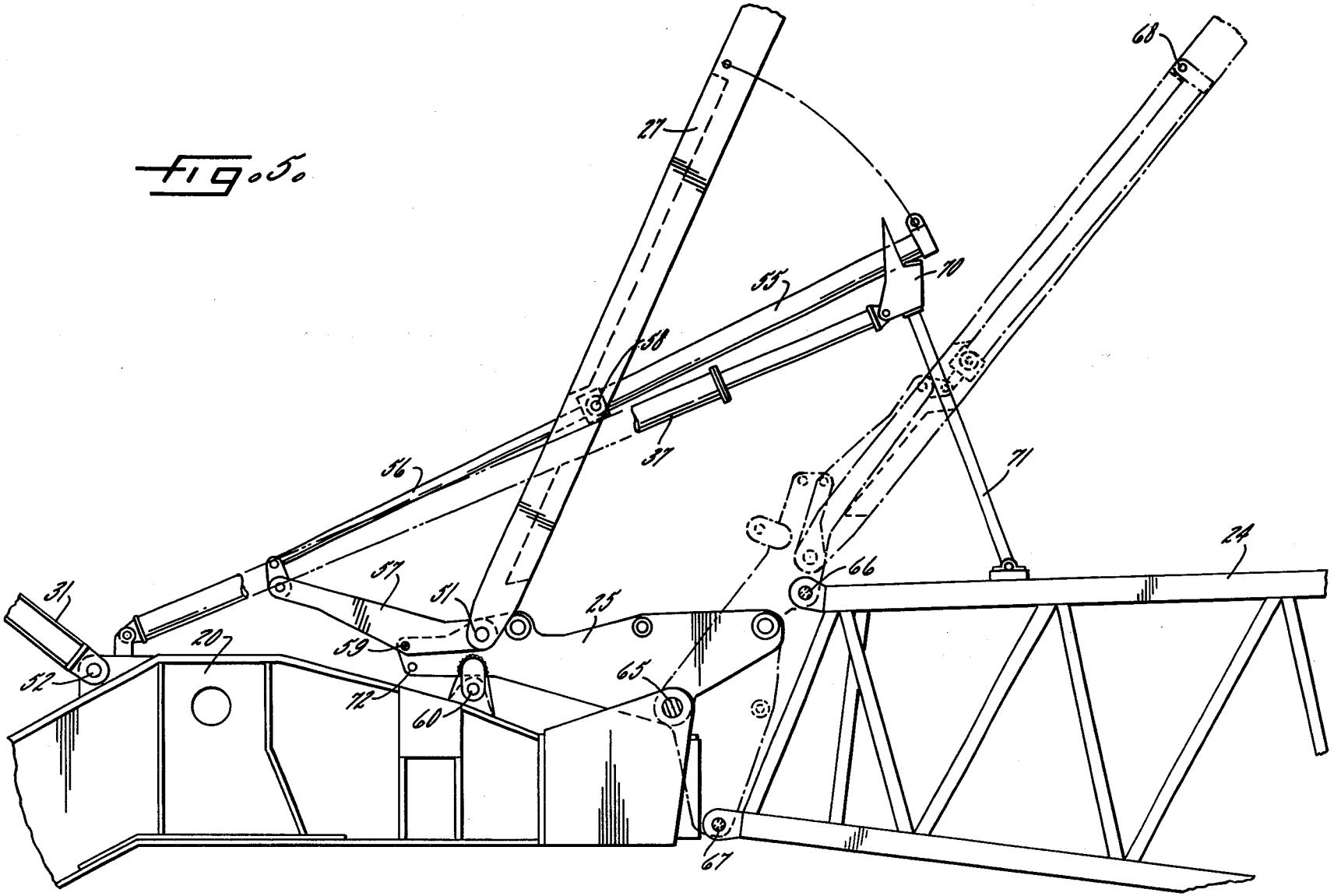

By paying out cable 29 the boom 24 is lowered to the dash line position of FIG. 5 and the pendants 26 and boom stop 37 are removed. The mast cylinders 55 are unpinned at 68 and the lever arms 57 are pinned in the upper holes 61 of the boom carrier 25. The boom 24 is then separated from the carrier by removing pins 66 and 67. By extending the mast cylinders 55, the arms 57 and carrier 25 are rotated about the main pivot 65 and the carrier is then secured to the rotating bed 20 with pin 60. The pins 59 are removed from the holes 61 and repinned in the lower holes 72 of the carrier 25. The masts 27 are rotated back over center by winding up cables 29 on the drums 33 and the masts 27 are then lowered to the solid line position in FIG. 2 by retracting the cylinders 55. The masts 27, gantry members 31 and links 36 are then folded down (to the dash line position of FIG. 2) for transport by retracting the back hitch cylinders 32. The mast cylinders 55 can then be fully retracted and pinned at 68 in their stored position within the masts 27.

Pursuant to another feature of the invention, the mast cylinders 55 may be employed as adjustable mast stops under certain operating conditions. Thus, as mentioned above, masts 27 can be rigged with a hoist line 40 or 41 and used as a temporary boom. When used in this manner, the masts 27 are normally positioned between the right-hand dash line position of FIG. 2 or inclined even more to the right. The carrier 25 is pinned to the bed at 60 and the pin 59 is removed and the arm 57 can rotate about the pivot 51 relative to the boom carrier depending on the extent the mast cylinders 55 are retracted. Because the point that the rear end of the arm 57 contacts the bed 20 changes, due to extension or retraction of the mast cylinders 55, the rear end of the arm 57 preferably carries a roller 75 which is free to roll along the upper surface 76 of the bed 20.

We claim as our invention:

1. A self-erecting mast and boom assembly for a lift crane having a supporting bed comprising, in combination, a mast and a gantry each pivotally mounted adjacent one end thereof on the bed such that the mast rests on a portion of the gantry when the mast and gantry are both pivoted down into substantially horizontal, rearwardly extending positions, means including a first hydraulic cylinder connected between the bed and the free end of the gantry for raising the gantry to working position and the mast to a rearwardly inclined intermediate position, and means including a second hydraulic cylinder connected between the bed and the mast for pivoting the mast from said intermediate position past vertical to a forwardly inclined position.

2. An assembly as defined in claim 11 including a boom carrier pivotally mounted on the bed by a first substantially horizontal pin, the mast being pivotally mounted by a second substantially horizontal pin on said carrier, an arm secured to said carrier and extending generally rearwardly therefrom, and said second hydraulic cylinder pivotally connected to said mast and having a piston rod connected to said arm for raising and lowering said mast relative to the bed.

3. An assembly as defined in claim 2 including means for selectively securing said arm to said carrier in a raised position and means including said second cylinder and piston rod for rotating said mast to a more forwardly inclined position.

4. An assembly as defined in claim 3 including a boom hoist line connected to said mast and means for paying out and reeving in said line, and wherein said arm, cylinder and mast form a substantially rigid connection with said carrier which is rotatable about said first pin as more of said hoist line is payed out or reeved in.

5. An assembly as defined in claim 2 wherein said second cylinder is rotatable to a stored position within said mast when said mast is aligned with said arm.

6. As assembly as defined in claim 2 wherein said arm is also pivotally mounted on said second pin and means is provided for selectively securing said arm to said carrier at least at one other point.

7. As assembly as defined in claim 2 wherein said arm is engageable with the bed and said second cylinder forms an adjustable back stop for said mast.

* * * * *